United States Patent [19]

Nakatsuka et al.

[11] Patent Number: 4,572,137

[45] Date of Patent: Feb. 25, 1986

[54] DISTRIBUTOR TYPE FUEL INJECTION PUMP

[75] Inventors: Hirotaka Nakatsuka, Kariya; Masahiko Miyaki, Oobu; Akira Masuda, Aichi, all of Japan

[73] Assignee: Nippondenso Co., Ltd., Kariya, Japan

[21] Appl. No.: 657,148

[22] Filed: Oct. 3, 1984

[30] Foreign Application Priority Data

Oct. 3, 1983 [JP] Japan ..... 58-185775

[51] Int. Cl.[4] ..... F02M 41/00

[52] U.S. Cl. ..... 123/450; 123/503; 417/462; 417/289

[58] Field of Search ..... 123/450, 449, 503, 501; 417/462, 289

[56] References Cited

U.S. PATENT DOCUMENTS

| | | | |
|---|---|---|---|
| 2,765,741 | 10/1956 | Hogeman | 123/450 |
| 2,935,062 | 5/1960 | Aldinger et al. | 123/450 |
| 3,752,138 | 8/1973 | Gaines | 123/450 |
| 4,441,474 | 4/1984 | Garrett et al. | 123/450 |

FOREIGN PATENT DOCUMENTS

| | | | |
|---|---|---|---|
| 2058947 | 4/1981 | United Kingdom | 123/503 |
| 2071784 | 9/1981 | United Kingdom | 123/450 |

*Primary Examiner*—Magdalen Y. C. Moy

*Attorney, Agent, or Firm*—Cushman, Darby & Cushman

[57] ABSTRACT

A distributor type fuel injection pump of the present invention is of the Lucas type having a rotor rotatably driven by an engine but not reciprocated. Spill ports of the same number as that of the cylinders of the engine communicating with a pump chamber are opened at an equal peripheral interval on the outer peripheral surface of the rotor, and a spill ring to cover the spill ports is slidably mounted on the outer peripheral surface of the rotor. A spill groove is formed to extend axially on the inner peripheral surface of this spill ring. One edge of the spill groove, which initially meets the respective spill ports during the pressurizing step for pressurizing the fuel in the pump chamber, is inclined to the axis, and the other edge of the spill groove is parallel to the axis.

4 Claims, 12 Drawing Figures

DISTRIBUTOR TYPE FUEL INJECTION PUMP

BACKGROUND OF THE INVENTION

The present invention relates to a distributor type fuel injection pump and, more particularly, to a Lucas type fuel injection pump.

As distributor type fuel injection pumps, a Lucas type fuel injection pump and a Bosch type fuel injection pump have been proposed. The Lucas type pump has a number of advantages such as a reduction in the pressure applied to the cam surface of the cam as compared with the Bosch type pump. However, in the Lucas type fuel injection pump, a rotor rotates as a fuel distributor member only but does not reciprocate. Thus, a spill type delivery control device based on the position control of a spill ring as applied to the Bosch type pump cannot be employed in the Lucas type pump. Then, in the conventional Lucas type pump, a throttle control device for controlling the delivery amount of throttling the fuel from the outlet of the pump is separately provided.

Therefore, the present inventors were able to control the delivery amount of fuel in spill type pump in the same manner as with the Bosch type pump in the Lucas type fuel injection pump by providing a spill ring oil-tightly and slidably mounted on the rotor, the spill ring having a lead groove 10*a* (hereinbelow referred to as "oblique lead") obliquely cut off on the inner peripheral surface thereof as shown in FIG. 1, forming spill ports in the rotor, the spill ports being connected to the pumping chamber of the pump, and controlling the relative position between the spill ports and the oblique lead.

However, in the Lucas type pump having the oblique lead and the spill ports, when the relative position between the spill ports and the oblique lead is varied by moving the spill rings axially on the rotor, not only the spill starting time at which time the spill ports communicate with the oblique lead but also the spill finishing time at which time the spill ports are closed by the spill ring is varied similar to the spill starting time. Thus, there is a range where the spill period and the fuel suction period overlaps resulting in insufficient fuel suction in this range, and decreased fuel suction efficiency.

SUMMARY OF THE INVENTION

It is an object of the present invention to provide a distributor type fuel injection pump capable of controlling the delivery amount of fuel in a spill type pump without losing the suction efficiency.

In order to achieve the above and other objects, there is provided according to the present invention a distributor type fuel injection pump for distributing fuel into a plurality of combustion chambers of an internal combustion engine comprising a rotor rotatably driven by the engine and defining a fuel passage and a pump chamber communicating with the fuel passage therein, pumping means for pressurizing fuel in the pump chamber by the rotatable drive of the rotor to deliver the pressurized fuel through the fuel passage of the rotor, the pumping means having a cam ring disposed coaxially to surround the rotor and formed with the cam surface on the inner peripheral surface thereof, and plungers reciprocating radially from the rotor in cooperation with the cam ring, thereby introducing fuel to the pump chamber and pressurizing the fuel introduced into the pump chamber; distributor means for distributing the pressurized fuel delivered from the pump chamber to the fuel passage by the pumping means toward the respective combustion chambers of the engine; spill means for releasing the pressurized fuel delivered from the pump chamber to the fuel passage; and control means for controlling the spill starting timing of the pressurized fuel to be released by the spill means and setting the spill finish timing of the pressurized fuel to the predetermined time before the step of introducing the fuel.

According to the present invention, the spilling period of the pressurized fuel and the introducing period of the fuel do not overlap because of the provision of the control means, which cooperates with the spill means, so the supply of fuel to the pump chamber can be reliably performed. Therefore, according to the present invention, the delivery amount of the pressurizing fuel can be controlled without adversely affecting the suction efficiency of the fuel in the same manner as the known fuel injection Bosch type pump even in the Lucas type fuel injection pump.

BRIEF DESCRIPTION OF THE DRAWINGS

FIG. 3 is a developed view showing the inner peripheral surface of the spill ring, FIGS. 4 and 5 are explanatory views of the operation showing the relative position between the lead grooves formed on the inner surface of the spill ring and one of the spill ports, FIGS. 4(*a*) and 5(*a*) are side sectional views of a part of the pump, FIGS. 4(*b*) and 5(*b*) are developed views of the inner peripheral surface of the spill ring;

FIG. 6(*a*) is a perspective view of a part of the pump, and FIG. 6(*b*) is a developed view of the inner peripheral surface of the spill ring;

DETAILED DESCRIPTION OF THE PREFERRED EMBODIMENTS

Distributor type fuel injection pumps according to the present invention will be described with reference to FIGS. 2 to 8.

Figure 2A:
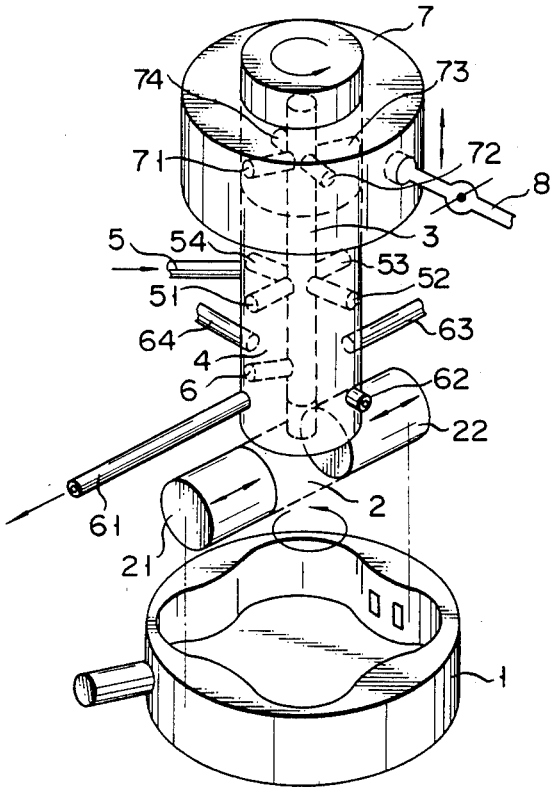
FIGS. 2 to 5 show a fuel injection pump according to a first embodiment of the present invention, FIG. 2(*a*) is a schematic view showing a part of a fuel injection pump, FIG. 2(*b*) is a fragmentary perspective view of a spill ring used in FIG. 2(*a*)

In FIG. 2, a cam ring 1 attached to a pump housing (not shown) is shown. A rotor 4 is disposed inside the cam ring 1, and rotated at the rotating speed of ½ of a known engine (not shown). This embodiment is applied to a 4-cylinder engine. Plungers 21, 22 slidably fitted radially in the rotor 4 are reciprocated in accordance with the profile of the cam surface of the cam ring 1 by the rotation of the rotor 4 to pressurize the fuel in the pump chamber 2 defined between the plungers 21 and 22. The pressurized fuel is fed through a fuel passage 3 in the rotor 4 communicating with the pump chamber 2 to a distributing port 6, and delivered into the respective cylinders of the engine through fuel supply passages 61 to 64, retraction valves and injection valves (not shown), when fuel supply passages 61 to 64 are connected to the distributing port 6 in accordance with the rotation of the rotor.

The fuel pressurized by a feed pump (not shown) is sucked in the pump chamber 2 and the fuel passage 3 through a supply port 5 and suction holes 51 to 54 prior to the delivery of the pressurized fuel.

Spill ports 71 to 74 communicating with the fuel passage 3 through the pump chamber 2 are defined in the rotor 4. In the rotor 4, a spill ring 7 is oil-tightly and slidably mounted on the rotor 4. Further, a lead groove, i.e., oblique lead 10 is formed on the inner peripheral surface of the spill ring 7. The oblique lead 10 is inclined to the generatrix of the inner peripheral surface of the spill ring 7 and is able to communicate with the outside of the spill ring 7.

As is apparent from the structure thus constructed, the relative positions between the spill ports 71 to 74 and the oblique lead 10 are controlled by axially moving the spill ring 7 on the rotor 4. Thus, the spill starting timing is varied, and the fuel injection amount can be controlled.

Figure 1:
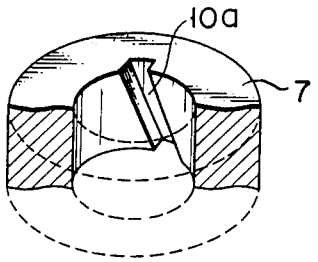
FIG. 1 (PRIOR ART)
FIG. 1 is a fragmentary perspective view showing a spill ring in a conventional example.

However, in the case of the spill ring 7 with the oblique lead 10*a* shown in FIG. 1, when the spill ring 7 moves axially on the rotor 4, not only the spill starting timing but also the spill finishing timing is varied similarly to the spill starting timing by the variation in the relative position between the spill ports 71 to 74 and the oblique lead 10*a*. As a result the the spill period and the fuel suction period may largely overlap. This will be further described with reference to FIG. 8.

Figure 8:
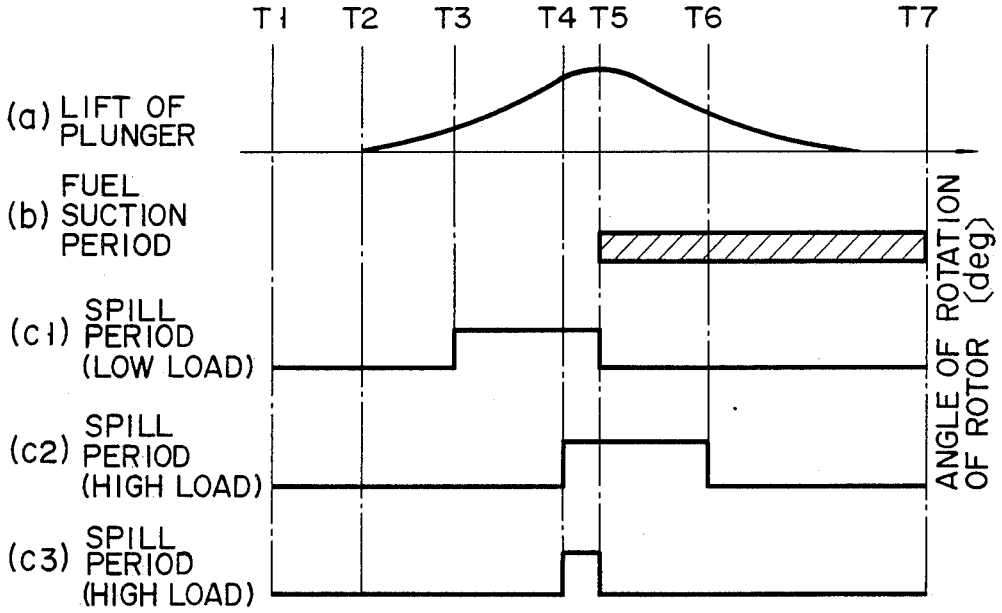
FIG. 8 is an explanatory view of the operation illustrating the relationship between the fuel suction period and the fuel spill period.

FIG. 8 shows the fuel suction period and the fuel spill period relative to the lift of the plungers 21 and 23. In FIG. 8, (a) shows the lift of plungers 21 and 23 (which is from the bottom dead center of the plunger to the top dead center of the plunger). An abscissa axis represents an angle of rotation of the rotor 4. Reference numerals T1 and T7 represent the bottom dead center of the plunger lift, and reference numeral T5 represents the top dead center of the plunger cam lift. The lift of the plungers 21 and 22 is started from the point designated by T2.

The fuel suction period is showing by (b), and the fuel supply port 5 is opened during this fuel suction period, i.e., during the period from the top dead center T5 to the bottom center point T7, and the fuel is sucked to the pump chamber 2.

An example of the spill period is shown by (c1), (c2) and (c3). For example, since the fuel injection amount is small when the engine is at low load (e.g., at an idling time), the spill port is opened at the time point T3 so that the pressurizing step of the fuel is not considerably advanced from the lift point T2 of the plungers 21 and 23, as shown in (c1), and the spill of the pressurized fuel is started. When the spill of the pressurized fuel is finished before the top dead center T5, the possibility of secondarily injecting the fuel is high. Therefore, the spill port is closed at the top dead center T5 to finish the spill of the pressurized fuel. When the engine load becomes high, fuel injection amount increases as compared with that at the low load time. Thus, the spill starting timing is delayed from the spill starting timing T3 at the low load time of (c1), e.g., started from the time point T4.

In this case, in the oblique lead 10*a* of the lead shape shown in FIG. 1, the spill starting timing is altered from the time point T3 to the time point T4, and the spill finishing timing is thus changed from the time point T4 to the time point T6. In other words, in case of the oblique lead 10*a* shown in FIG. 1, the spill period (T3 to T5 in case of c1, and T4 to T6 in case of c2) is constant. Thus, when the spill starting timing is altered, the spill finishing timing is also changed.

As a result, a range in which the spill period and the fuel suction period largely overlap is created, resulting in a decrease in the fuel suction efficiency and distributing the fuel injection characteristics.

As shown as an example in c3, this problem of overlapping that can be eliminated by always maintaining the spill finishing period at a constant period (in this case, at the top dead center T5) even if the spill starting timing is altered from the time point T3 to the time point T4 because the engine load is high.

Figure 2B:
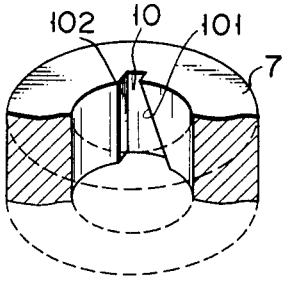

In the first embodiment of the present invention, as is apparent from the spill ring 7 in FIG. 2*b*, the shape of the oblique lead 10 (hereinbelow termed to as "a spill lead 10") is formed as below, which is different from the spill leads 10*a* shown in FIG. 1.

Figure 3:
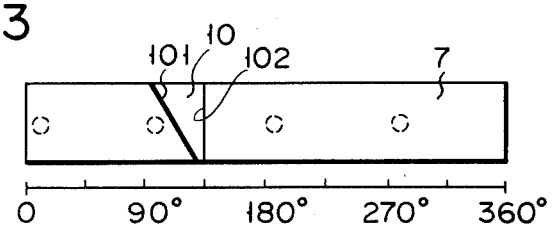

One spill starting side edge 101 of the shoulder edge of the groove forming the spill lead 10 is inclined to the generatrix of the inner peripheral surface of the spill ring 7, while the other spill finishing side edge 102 is parallel to the generatrix. Thus, as described with respect to FIG. 8, the spill finishing timing can be always maintained at a constant timing even if the spill ring 7 moves on the rotor 4 to vary the spill starting period. In FIG. 3, a developed view of the inner peripheral surface of the spill ring 7 is shown.

The operation for controlling the fuel injection amount by the spill control with the structure thus constructed will be described with reference to FIGS. 4 and 5.

Figure 4A:
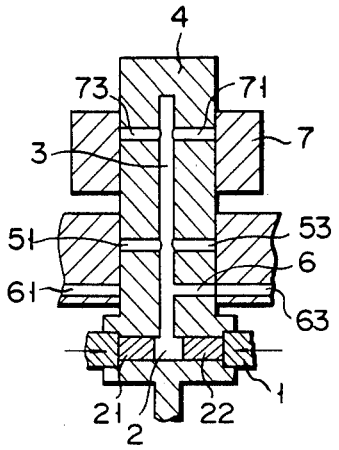
Figure 4B:
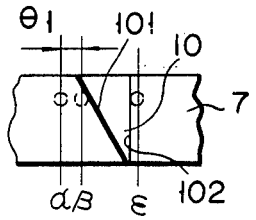
Figure 5A:
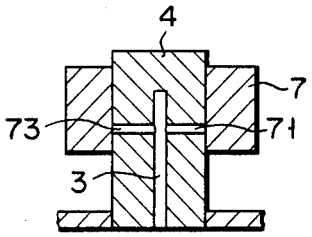

In FIG. 4, when one of the spill ports 71 to 74 is brought to the position $\alpha$ shown in FIG. 4*b*, which shows a developed view of the inner peripheral surface of the spill ring 7, the pressurizing and delivering of the fuel are started. Then, the rotor 4 is rotated, the pressurized fuel is delivered from the distributing port 6 to one of fuel injection valves of the engine through corresponding fuel supply passage, until the spill port coincides with the edge 101 the spill lead 10 of the spill ring 7. When the spill lead 10 coincides with one of the spill port at the position $\beta$ in FIG. 4*b*, the pressurized fuel in the pump chamber 2 and the fuel passage 3 escapes through the spill lead 10 to the outside of the rotor 4 (i.e., into the fuel supply chamber defined in the pump housing, not shown) and the delivery of the pressurized fuel, i.e., the injective is finished. In other words, the fuel is delivered under pressure during a rotating angle $\theta_1$ from the position $\alpha$ to the position $\beta$, and the amount of the fuel in accordance with the pressurizing period is injected.

The communication between the spill lead 10 and one of the spill ports is closed at the position $\epsilon$ in FIG. 4*b*, and the spill of the pressurized fuel is finished. In other words, the period from the position $\beta$ to the position $\epsilon$ is the spill period.

Then, when the position of the spill ring 7 is changed relatively to the rotor 4 (upward in the drawing of FIG. 5), the spill timing at the position $\beta$ in FIG. 4 is changed to the position $\gamma$ according to the shape characteristic of the edge 101 of the spill lead 10, and the pressurizing period increases from $\theta_1$ to $\theta_2$, with the result that the fuel injection amount is also increased. In other words, the spill amount of the fuel is varied by moving the spill ring 7 on the rotor 4 in the axial direction of the rotor 4, thereby controlling the injection amount of the fuel.

Figure 5B:
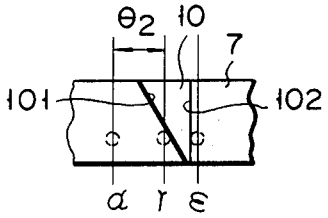

Similarly to FIG. 4*b*, the communication between the spill lead 10 and one of the spill ports is closed at the position $\epsilon$ in FIG. 5*b* of the developed view, and the spill of the pressurized fuel is finished. In other words, the period from the position $\gamma$ to the position $\epsilon$ is the spill period.

Therefore, the fuel injection amount can be controlled by changing the spill starting timing by moving the spill ring 7 on the rotor 4 in the axial direction thereof, and the overlap between spill period and the fuel suction period can be reliably prevented by always maintaining the spill finishing timing at the top dead center T5 or at a constant time point of the vicinity of the top dead center T5 of the plunger lift.

Consequently, the problem that the fuel suction efficiency is decreased due to the overlapping of the spill period and the fuel suction period can be eliminated.

The control of the position of the spill ring 7 can be readily achieved by employing known means such as a hydraulic servo or a linear solenoid type actuator.

Figure 6A:
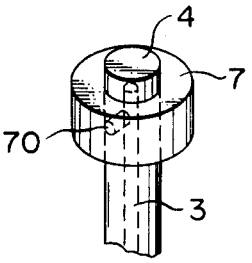
FIG. 6 show an essential section of a second embodiment of the present invention.
Figure 6B:
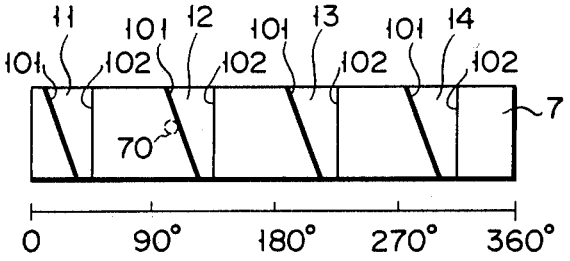

FIG. 6 show a second embodiment of the present invention, FIG. 6*a* shows a perspective view of the spill ring 7, and FIG. 6*b* shows a developed view of the inner peripheral surface of the spill ring 7. In the second embodiment, though the first embodiment employed four spill ports and one spill lead 10 for a 4-cylinder engine, one spill port 70 and four spill leads 11 to 14 are provided in this case.

Figure 7:
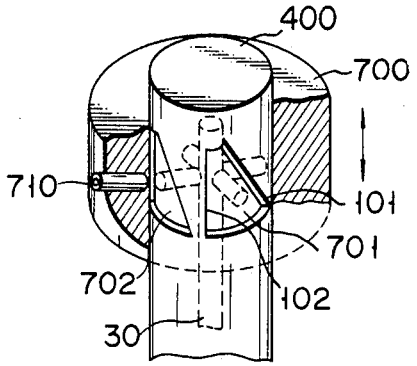
FIG. 7 is a fragmentary perspective view of an essential section of a third embodiment of the pump.

FIG. 7 shows a third embodiment of the present invention. Spill leads 701 to 704 are formed on the outer peripheral surface of a rotor 400, and a spill port 710 is formed in the spill ring 700. In this case, the relative position between the spill lead 701 and the spill port 710 is similar to those in the first and second embodiments, and the controlling method can be similarly operated.

What is claimed is:

1. A distributor type fuel injection pump for distributing fuel into combustion chambers of an internal combustion engine comprising:

a rotor rotatably driven by the engine and having therein a fuel passage coaxial with the rotor axis and a pump chamber communicating with the fuel passage, pumping means for pressurizing fuel in the pump chamber by the rotatable drive of the rotor to deliver the pressurized fuel through the fuel passage, the pumping means having a cam ring disposed coaxially to surround the rotor and formed with a cam surface on the inner peripheral surface thereof and plungers reciprocating radially of the rotor in cooperation with the cam ring, thereby introducing fuel to the pump chamber and pressurizing the fuel introduced into the pump chamber;

distributing means for distributing the pressurized fuel delivered from the pump chamber to the fuel passage by the pumping means toward the respective combustion chambers of the engine; and adjusting means for adjusting the quantity of pressurized fuel to be distributed by spilling the pressurized fuel delivered from the pump chamber to the fuel passage, said adjusting means including control means which controls a spill start time at which the spill of the pressurized fuel contained in the fuel passage is started and which sets, before the introduction of the fuel is started, a spill finish time at which the spill of the pressurized fuel contained in the fuel passage is stopped.

2. The distributor type fuel injection pump according to claim 1, wherein the adjusting means comprises spill holes formed in the same number as the combustion chambers of the engine in the rotor, each of the spill holes communicating at one end independently with the fuel passage and opened at the other end to the outer peripheral surface of the rotor, the open other ends being arranged at equal circumferential intervals on the outer peripheral surface of the rotor; a spill ring liquid-tightly and slidably mounted on the outer peripheral surface of the rotor so as to cover the open other ends of the spill holes; and a spill groove formed to extend axially on the inner peripheral surface of the spill ring in such a manner that one edge of the spill groove, which initially meets the respective open other ends of the spill holes upon rotation of the rotor during the pressurization of the fuel, is inclined to the axis of the rotor, and the other edge of the spill groove is parallel to the axis of the rotor.

3. The distributor type fuel injection pump according to claim 1, wherein the adjusting means comprises a spill hole formed in the rotor, the spill hole communicating at one end thereof with the fuel passage with the other end opening to the outer peripheral surface of the rotor; a spill ring liquid-tightly and slidably mounted on the outer peripheral surface of the rotor so as to cover the opening end of the spill hole; and spill grooves arranged in the same number as the combustion chambers of the engine on the inner peripheral surface of the spill ring so as to extend axially at equal circumferential intervals in such a manner that one edge of the respective spill grooves, which initially meets the opening end of the spill hole upon rotation of the rotor during the pressurization of the fuel, is inclined to the axis of the rotor, and the other edge of the respective spill grooves is parallel to the axis of the rotor.

4. The distributor type fuel injection pump according to claim 1, wherein the adjusting means comprises a spill ring, which is slidably and liquid-tightly mounted on the outer peripheral surface of the rotor, the spill ring including a spill hole opening at one end to the inner peripheral surface of the spill ring, spill grooves arranged at equal circumferential intervals on the outer peripheral surface of the rotor covered by the spill ring in the same number as the combustion chambers of the engine, the spill grooves being formed to extend in the axial direction of the rotor in such a manner that one edge of the respective spill grooves, which initially meets the opening end of the spill hole upon rotation of the rotor during the pressurization of the fuel, is inclined to the axis of the rotor, and the other edge of the respective spill grooves is parallel to the axis of the rotor, and communicating holes formed in the rotor for communication independently between the spill grooves and the fuel passage.

* * * * *